US006200175B1

(12) United States Patent
Natsume

(10) Patent No.: US 6,200,175 B1
(45) Date of Patent: Mar. 13, 2001

(54) MOUNTING ARRANGEMENT FOR OUTBOARD MOTOR

(75) Inventor: Noriyuki Natsume, Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/315,922

(22) Filed: May 20, 1999

(30) Foreign Application Priority Data

May 22, 1998 (JP) ..... 10-141094
May 22, 1998 (JP) ..... 10-141095
May 22, 1998 (JP) ..... 10-141096

(51) Int. Cl.[7] ..... B63H 20/08
(52) U.S. Cl. ..... 440/2; 440/55; 440/61
(58) Field of Search ..... 440/2, 61, 55, 440/56, 52, 53; 248/643

(56) References Cited

U.S. PATENT DOCUMENTS 3,486,724 * 12/1969 Adamski ..... 440/61
4,826,459 * 5/1989 Slattery ..... 440/63
4,986,773 * 1/1991 Binversie ..... 440/61
5,004,439 * 4/1991 Onoue ..... 440/2
5,358,436 * 10/1994 Soda et al. ..... 440/61
5,514,012 * 5/1996 Natsuma ..... 440/61

FOREIGN PATENT DOCUMENTS 58-136594 * 8/1983 (JP) ..... 440/61

* cited by examiner

*Primary Examiner*—Sherman Basinger
(74) *Attorney, Agent, or Firm*—Knobbe, Martens, Olson & Bear LLP

(57) ABSTRACT

An outboard motor mounting arrangement wherein the swivel bracket and clamping brackets have interengaging sliding surfaces that take side thrusts and minimize loading on the tilt pin during trim operation. In addition, certain electrical cables and hydraulic conduits are juxtaposed to the steering shaft and mounted so that they pass through the various brackets in a location close to the various pivotal axes to minimize flexure and reduce the necessary length therefor.

16 Claims, 8 Drawing Sheets

MOUNTING ARRANGEMENT FOR OUTBOARD MOTOR

BACKGROUND OF THE INVENTION

This invention relates to an outboard motor and more particularly to a mounting arrangement for the outboard motor that facilitates its tilt and trim movement to provide stability and good support and also that permits the use of conduits that extend from components carried by the lower portion of the outboard motor to external devices while minimizing length and permitting the tilt and trim movement without obstruction to the conduit.

It is generally known that outboard motors are supported on the transom of a watercraft and the propulsion unit portion of the outboard motor is movable about a vertically extending steering axis for steering of the outboard motor and the associated watercraft and for tilt and trim movement so as to adjust the angle of attack of the propeller or propulsion unit and also so as to permit the propulsion unit so as to be raised out of the water. Thus, the movement of the propulsion unit relative to its connection to the watercraft requires movement in two distinct planes about two generally perpendicular axes.

It is desirable that the steering and tilt and trim movement be permitted relatively freely but it is also necessary that the side thrust and side loading on the outboard motor be well absorbed so as to provide insurance against wear on the members that form both the tilt and the steering axes.

Generally, the clamping bracket which is affixed to the transom of the watercraft has a pair of side plates that have a series of spaced apertures for receiving a trim pin for taking the forward thrust of the drive and for permitting trim adjustment in the maximum trim-down position. However, the pivot pin for the tilt operation must absorb large portions of the side thrust and this can placed unduly high wear on the trim pin.

It is, therefore, a principal object of this invention to provide an improved mounting arrangement for an outboard motor.

It is a further object of this invention to provide an improved side force taking arrangement that cooperates between the clamping bracket and the swivel bracket so as to accommodate side forces in the normal trim range of movement.

It is a further object of this invention to provide an improved side thrust taking arrangement between the clamping bracket and the swivel bracket which does not restrict the degree of steering movement of the outboard motor.

In addition to the thrust taking and wear problem, there is also the necessity to provide certain connections or conduits that extend between portions of the outboard motor and the interior of the watercraft. For example, a speed sensor of the pitot type is frequently used. In this type of device, the sensor is positioned at the forward portion of the lower unit. The sensor output is transmitted through either an electrical conductor or as a fluid pressure through a fluid conduit to an instrument mounted in the interior of the watercraft.

The conduit or conductor must accommodate both the tilt movement, the trim movement and also the steering movement. This can present significant problems, particularly that of binding or damage to the transmitter.

It is, therefore, a still further object of this invention to provide an improved conductor arrangement for conducting signals or electricity from the lower unit to the watercraft without binding or obstruction of the tilt and trim and steering movement.

Many times the outboard motor is provided with an electro-hydraulic system for assisting in the trim and tilt movement. Generally, this includes a reversible electric motor that drives a reversible hydraulic pump for supplying hydraulic fluid to the tilt and trim mechanism. Again, this requires electrical conductors to extend from the electric motor to the interior of the watercraft for control purposes. These conductors should be neatly arranged but also should be constructed so that they do not provide binding or unsightly appearance when the outboard motor is steered or effects tilt and trim.

SUMMARY OF THE INVENTION

This invention is adapted to be embodied in an outboard motor having a propulsion unit comprised of a power head containing a powering internal combustion engine or other prime mover and a lower unit that contains a propulsion device driven by the prime mover and a transmission for effecting this driving connection. The propulsion unit is mounted on a steering shaft within a swivel bracket for permitting steering movement of the outboard motor about a generally vertically extending steering axis. The swivel bracket is, in turn, connected by a pivot pin to a clamping bracket that is affixed to the hull of an associated watercraft. This pivotal connection permits tilt and trim movement of the swivel bracket and propulsion unit relative to the clamping bracket and watercraft hull. The clamping bracket is comprised primarily of a pair of spaced apart side plates that extend along opposite sides of the swivel bracket.

In accordance with a first feature of the invention, interengaging, thrust-taking pads are formed on the swivel bracket and side plates of the clamping bracket so as to take side thrusts during at least the trim range of movement of the outboard motor.

In accordance with another feature of the invention, a conductor for conducting either fluid or electrical energy extends from a forward portion of the lower unit upwardly in an area contiguous to the axis defined by the steering shaft and passes through the protective cowling of the outboard motor for transmitting signals.

In accordance with yet another feature of the invention, a hydraulic tilt and trim unit acts between the swivel bracket and clamping bracket for effecting the tilt and trim movement. This unit is electrically powered and electrical conductors extend from this unit generally upwardly to a position close to the trim and tilt pin axis and from there pass through the protective cowling for transmitting electrical power to the tilt and trim unit.

DETAILED DESCRIPTION OF THE PREFERRED EMBODIMENTS OF THE INVENTION

Figure 1:
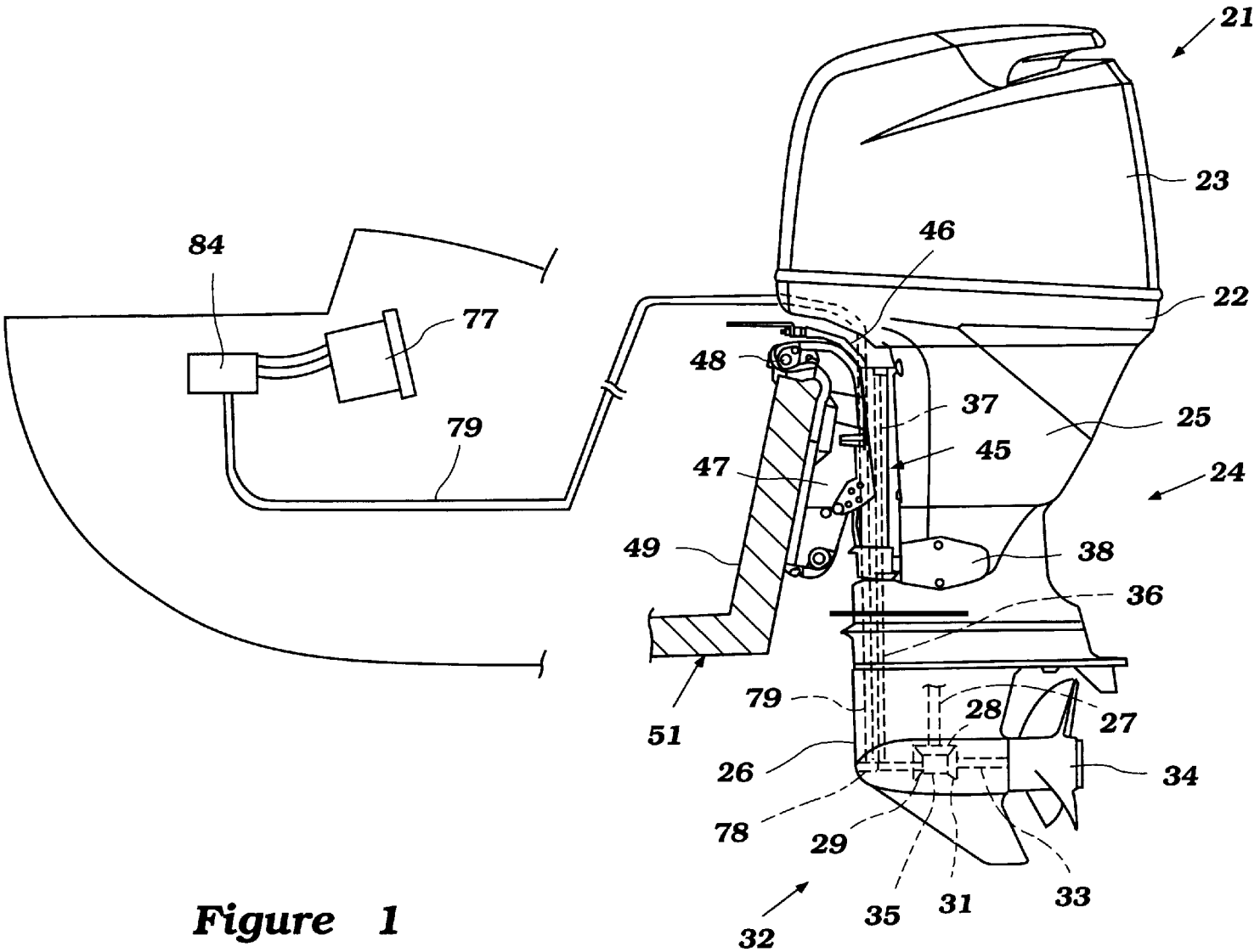
FIG. 1 is a side elevational view showing an outboard motor constructed in accordance with an embodiment of the invention as attached to the transom of an associated watercraft which is shown partially in phantom and partially in cross section.
Figure 2:
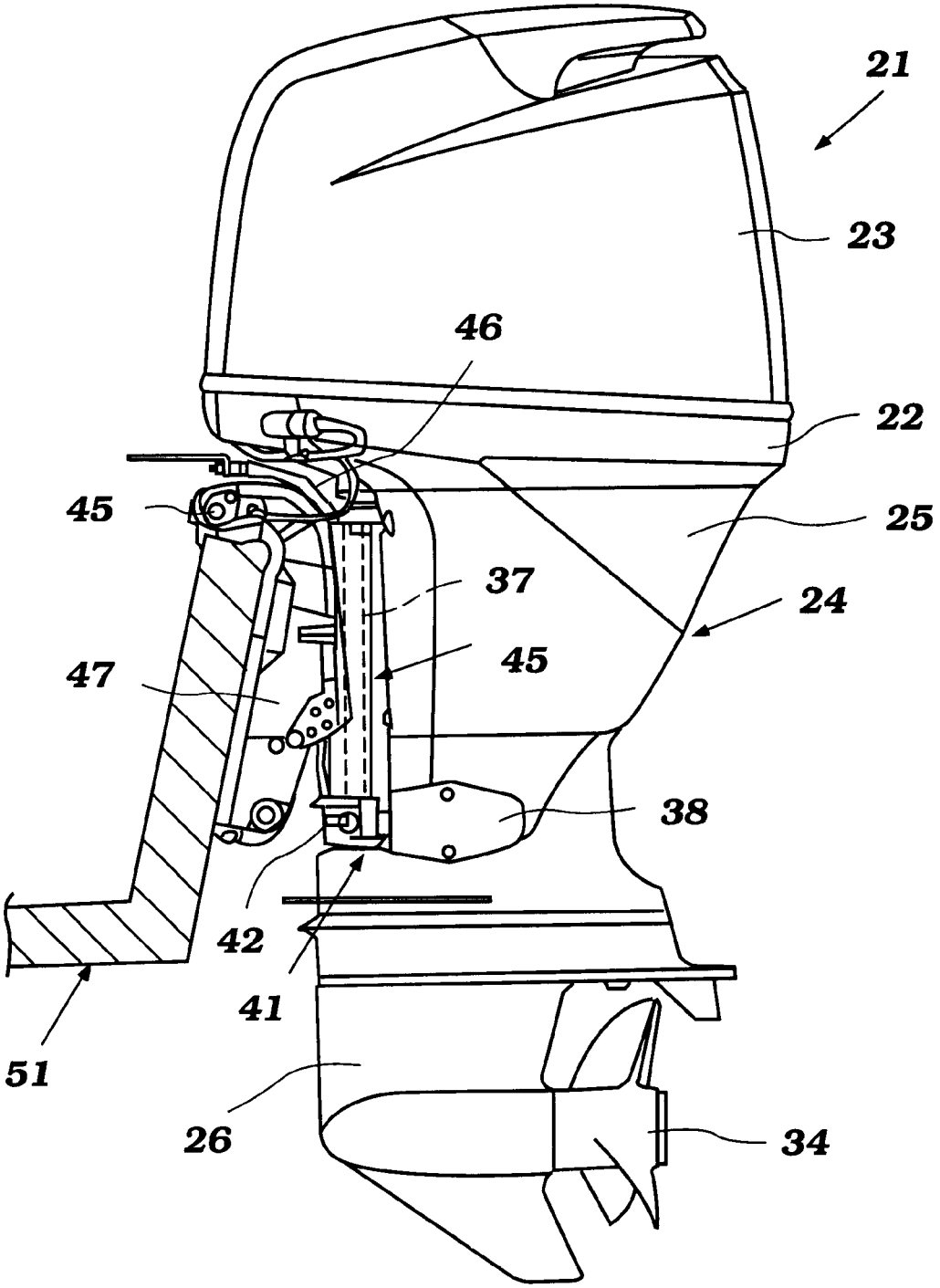
FIG. 2 is a side elevational view in part similar to FIG. 1 and showing only the outboard Motor and its attachment to the transom of the watercraft and also showing in more detail certain of the electrical connections associated therewith.

Referring now in detail to the drawings and initially primarily to FIGS. 1 and 2, an outboard motor constructed in accordance with an embodiment of the invention is identified generally by the reference numeral 21. Except for the supporting arrangement for the outboard motor 21 and certain electrical and hydraulic connections therefor, the construction of the outboard motor 21 may be considered to be conventional.

Therefore, the structure of the outboard motor 21, except for the aforenoted specific features will be described only generally. Where components of the outboard motor 21 are not illustrated or described, those skilled in the art can readily use any desired constructions with which to practice the invention.

The outboard motor 21 is comprised of a power head at the upper end thereof which consists of a powering internal combustion engine that is not shown and which his contained within a protective cowling. This protective cowling is comprised of a lower tray portion 22 to which an upper main cowling portion 23 is detachably connected. These cowling portions 22 and 23 contain and protect the engine and give a neat overall appearance to the outboard motor 21.

A drive shaft housing lower unit assembly 24 depends from the power head and the upper portion thereof is at least partially encircled by the tray portion 22. This unit 24 includes a main drive shaft housing unit 25 and a lower unit housing 26 which are detachably connected to each other in any suitable manner.

As is typical with outboard motor practice, the aforenoted, but unillustrated engine is mounted within the power head so that its output shaft rotates about a generally vertically extending axis. This is done so as to facilitate connection of this output shaft to a drive shaft 27 (FIG. 1) which depends into the drive shaft housing 25 and which terminates in the lower unit housing 26.

A driving bevel gear 28 is affixed to the lower end of this drive shaft 27 and drives a pair of counter-rotating driven bevel gears 29 and 31 of a conventional reversing type transmission, indicated generally by the reference numeral 32. The transmission 32 is utilized so as to drive a propulsion unit such as a propeller shaft 33 and propeller 34 in selected forward or reverse conditions.

The driven bevel gears 29 and 31 are suitably journaled for rotation on the propeller shaft 33. A dog clutching element 35 is splined to the propeller shaft 33 and is adapted to be shifted into engagement with corresponding clutching teeth formed on the driven bevel gears 29 and 31 so as to drivably couple selected of these gears with the propeller shaft 33 to accomplish the desired direction of drive.

A shift rod 36 extends upwardly through the lower unit housing 26 and drive shaft housing 25 for control by a remote operator (not shown) so as to control the transmission 32 in a well-known manner.

The manner in which the propulsion unit of the outboard motor 21 that is comprised of the power head and drive shaft housing lower unit 24 is connected to the associated watercraft will now be described making reference to additional of the figures. Initially, reference may be had primarily to FIGS. 3 and 4 in addition to FIGS. I and 2 to follow this description.

Figure 3:
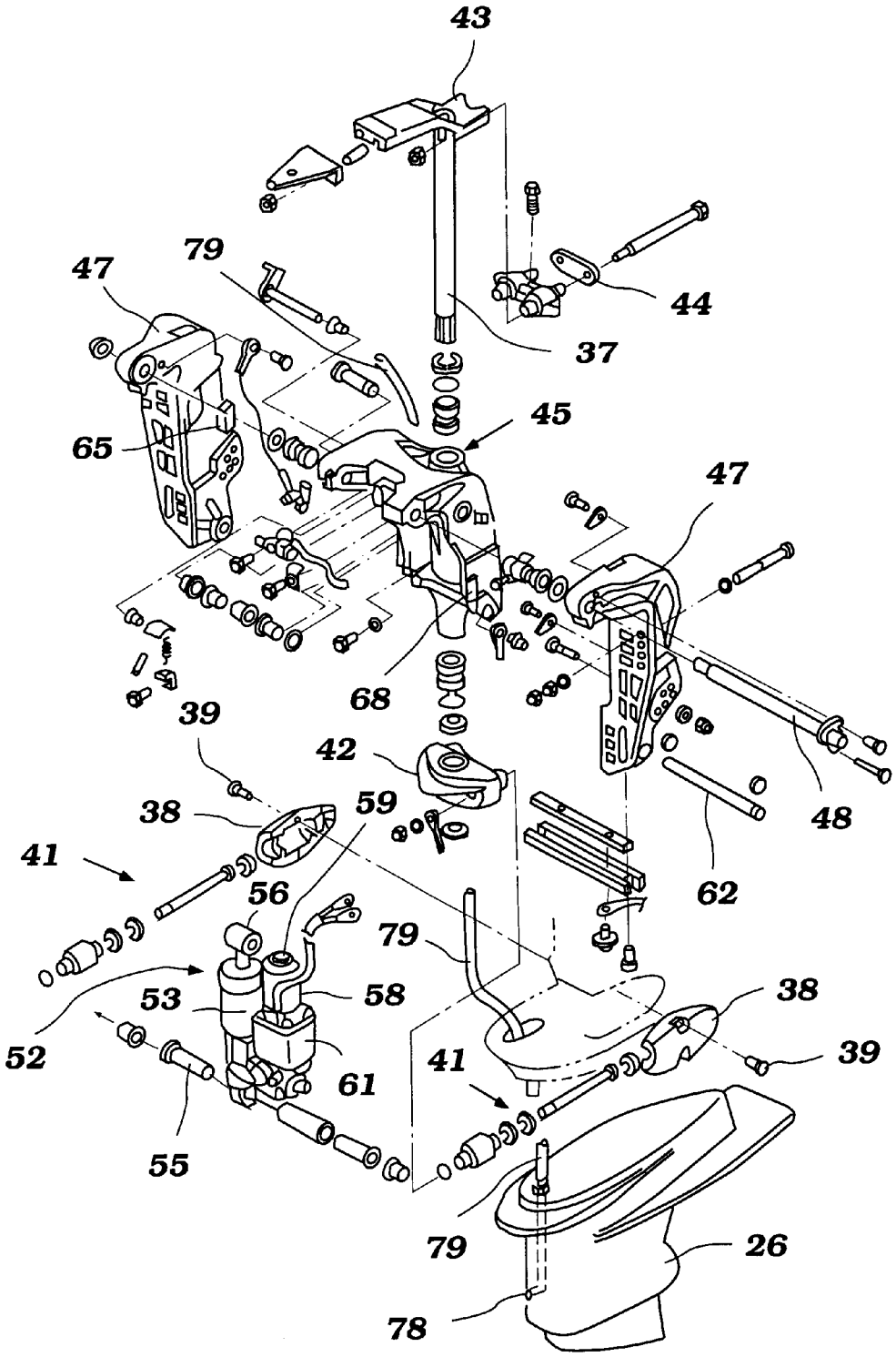
FIG. 3 is an exploded perspective view showing the mounting arrangement for the motor and the lower unit and its watercraft speed sensing connection.

A steering shaft 37 is mounted at the front of the drive shaft housing 26 by means that include a pair of lower supporting brackets 38 which are affixed to opposite sides of the drive shaft housing 25 by means of fasteners 39 as best seen in FIG. 3. These brackets 38 are connected by elastomeric damping assemblies, indicated generally at 41, to a lower steering shaft bracket 42. This lower bracket 42 is, in turn, affixed to the lower end of the steering shaft 37.

The upper end of the steering shaft 37 is connected to an upper bracket 43. The upper bracket 43 is connected by an elastomeric damping arrangement 44 to an upper portion of the drive shaft housing 25 in a manner that is well known in this art.

The steering shaft 37 and particularly the portion between the lower and upper brackets 42 and 43 is journaled within a swivel bracket assembly, indicated generally by the reference numeral 45. Hence, steering movement of the outboard motor 21 and specifically the propulsion portion thereof is accommodated by rotation of the steering shaft 37 within the swivel bracket assembly 45. The forward portion of the upper bracket 43 includes a tiller portion 46 so as to facilitate this steering operation.

The swivel bracket 45 is connected to a clamping bracket assembly that is comprised of a pair of spaced apart clamping brackets 47. A pivot pin 48 is fixed at its ends in these clamping brackets 47 and is journaled within suitable bearings of the swivel bracket 45 so as to accommodate tilt and trim up adjustment of the outboard motor 21. The clamping brackets 47 are suitably affixed to a transom 49 of the hull of a watercraft, indicated generally by the reference numeral 51.

Figure 8:
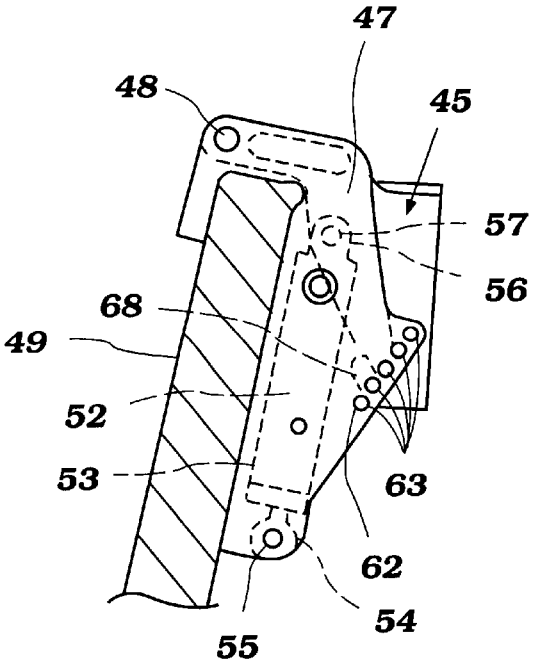
FIG. 8 is a view looking in the same direction as FIG. 5 and showing the fully trimmed down position.
Figure 9:
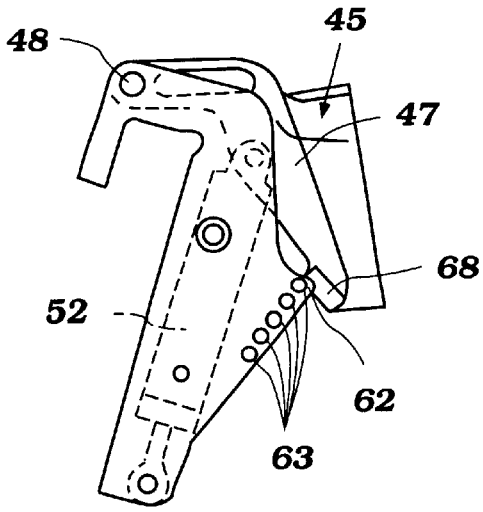
FIG. 9 is a view, in part similar to FIG. 5 and 8 but shows the fully trimmed up position.
Figure 13:
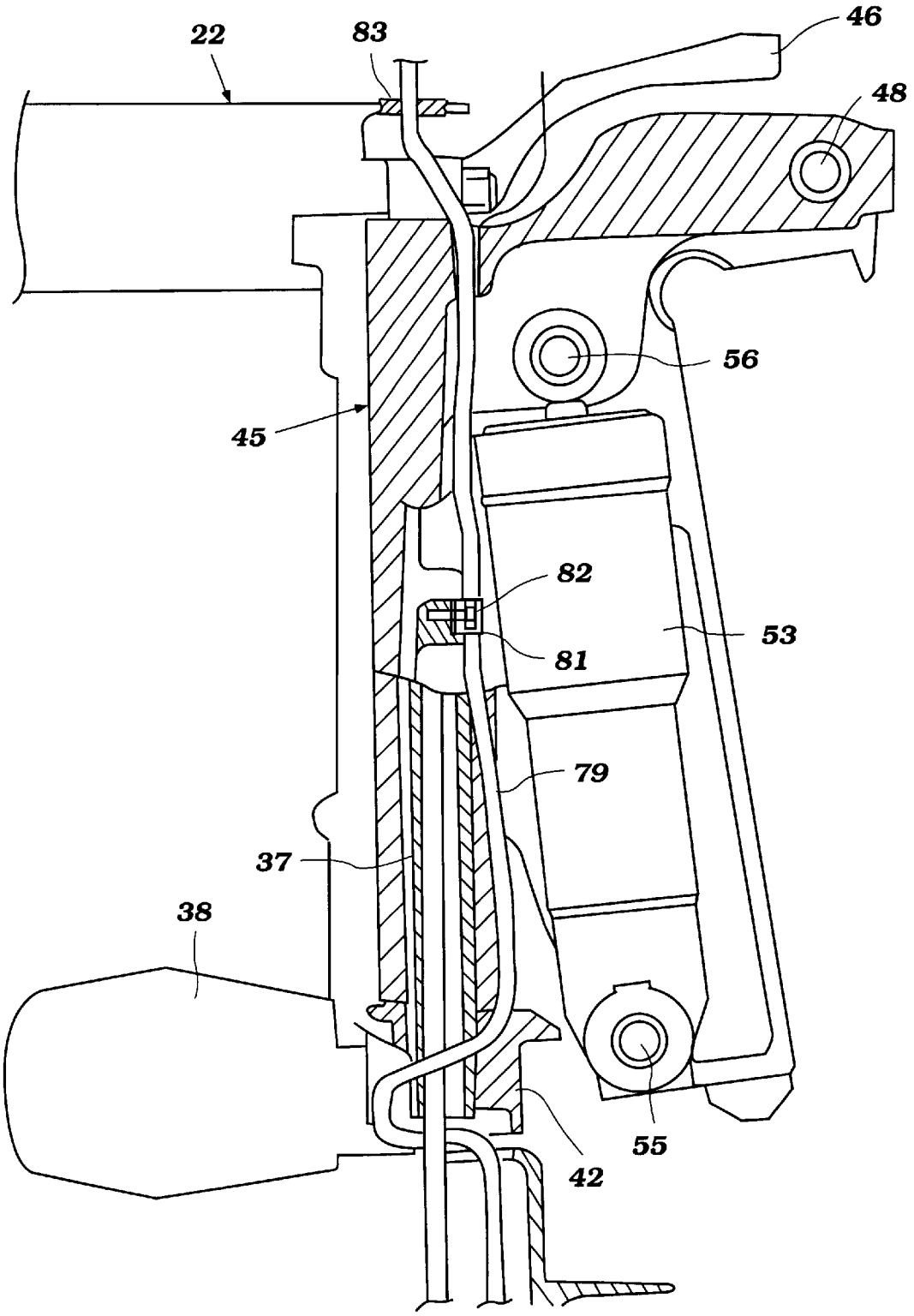
FIG. 13 is an enlarged cross-sectional view showing how the speed sensor signal is transmitted through the power head to the associated watercraft and how this avoids kinking or bending of the conductors or conduits upon steering motion.

A hydraulic tilt and trim control mechanism, indicated generally by the reference numeral 52 and shown additionally in FIGS. 8, 9, and 13, is interposed between the clamping brackets 47 and the swivel bracket 45 so as to permit hydraulic trim and tilt adjustment. As is typical with these type of mechanisms, the hydraulic tilt and trim unit 52 also includes a damping mechanism so as to permit the outboard motor 21 and swivel bracket 45 to "pop up" when an underwater obstacle may be struck by the lower unit 26 to avoid damage. Once this underwater obstacle is cleared, the unit will return to its preset trim adjusted position, as is well known in this art.

This tilt and trim adjusting mechanism 52, although it per se forms no part of the invention, will be described in some detail because the manner in which electrical power is delivered to it does form a part of the invention. The tilt and trim unit 52 is comprised of a tilt cylinder 53 that has a trunion portion 54 that is pivotally connected to the lower ends of the clamping brackets 47 by means of a pivot pin 55. This pivotal connection may be either to a piston rod of the tilt cylinder 53 or to the cylinder body assembly, either of which constructions are well known in the art.

The remainder of these two components (either the piston rod or cylinder body), has an upper trunion portion 56 that has a pivotal connection by means of a pivot pin 57 to the swivel bracket 45.

This cylinder assembly 53 also includes the aforenoted shock absorbing mechanism so as to permit the outboard motor 21 to pop up when an underwater obstacle is struck and to return to its preset trim position once this underwater obstacle is clear. This is normally provided by a valving arrangement internally of the cylinder assembly 53.

The trim position of the outboard motor 21 is primarily controlled by a trim cylinder 58 that has a piston 59 that is abuttingly engaged with a portion of the swivel bracket 45 for this purpose.

The trim cylinder 58 and tilt cylinder 53 are controlled and supplied with hydraulic fluid under pressure by a reversible electric pump 61 and control valve assembly of any suitable and known type. Because the exact construction for this mechanism may be of any known type for the reasons aforenoted and the invention deals primarily with the way in which the electrical signals and controls are provided to the tilt and trim arrangement 52 and that will be discussed later, further description of the hydraulic circuitry is not believed necessary.

Figure 5:
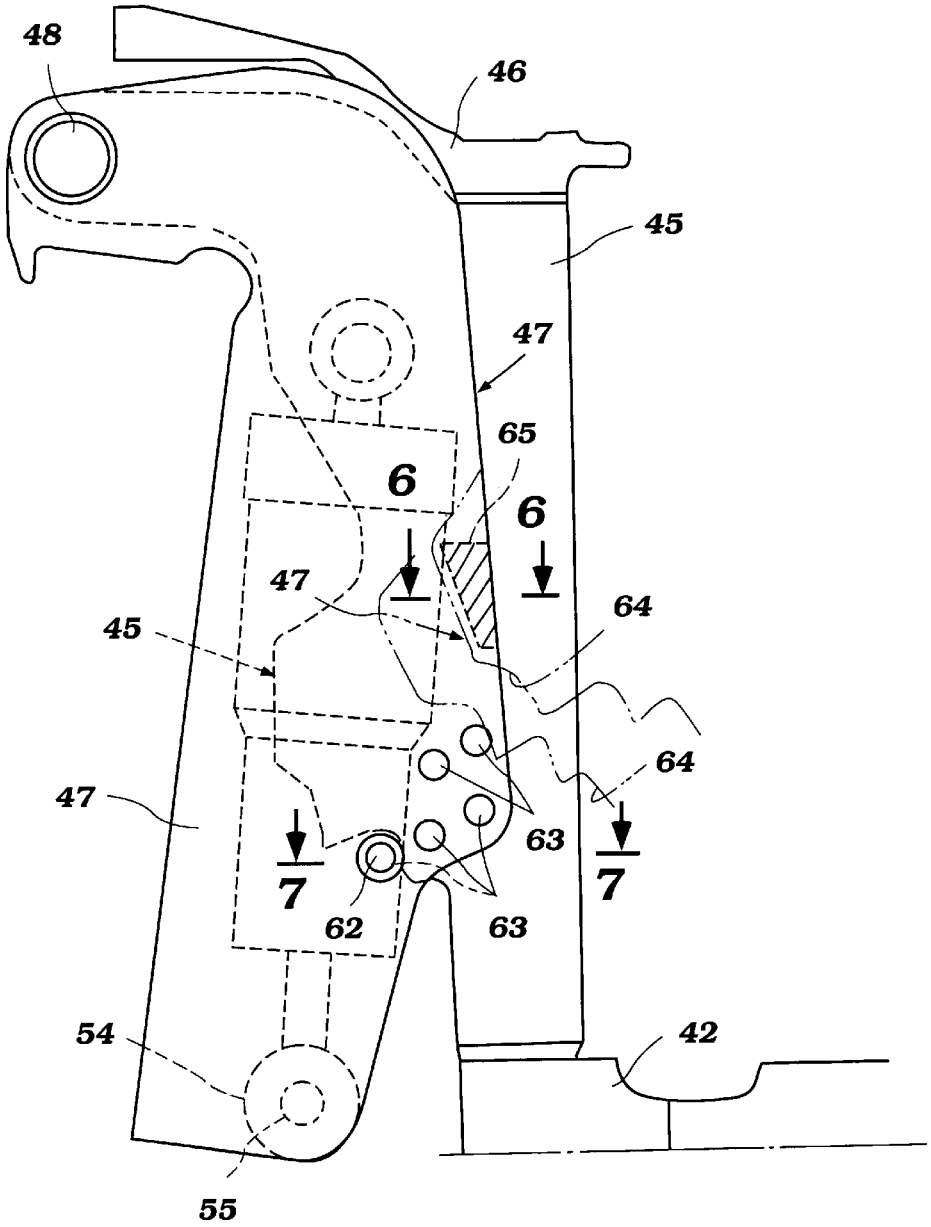
FIG. 5 is a side elevational view of the clamping and swivel brackets and shows the side thrust taking arrangement associated therewith.
Figure 6:
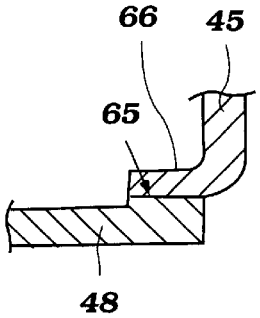
FIG. 6 is an enlarged cross-sectional view taken along the line 6—6 of FIG. 5.
Figure 7:
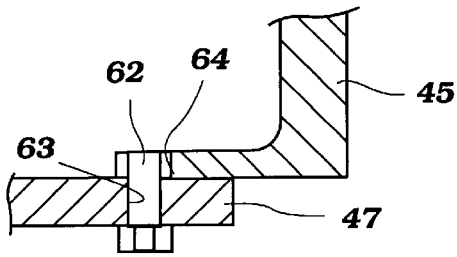
FIG. 7 is an enlarged cross-sectional view taken along the line 7—7 of FIG. 5.

Although the hydraulic tilt and trim mechanism 52 provides control of the tilt and trim position of the outboard motor, the maximum trim down condition is limited by a mechanism shown best in FIGS. 5, 8, and 9, and which includes a trim pin 62 that is received within selected ones of apertures 63 formed in the clamping bracket 47. FIGS. 5 and 8 show the trim pin 62 in the maximum trim down position while FIG. 9 shows the trim pin in the maximum trim up condition.

The forward portion of the swivel bracket 45 is provided with a plurality of notched recesses 64 which cooperate with the trim pin 62 to provide this control. It should be apparent from this arrangement that the side thrust on the outboard motor are, with conventional type of mounting arrangements, borne primarily or entirely by the trim pin 48. This can cause wear and binding.

Figure 10:
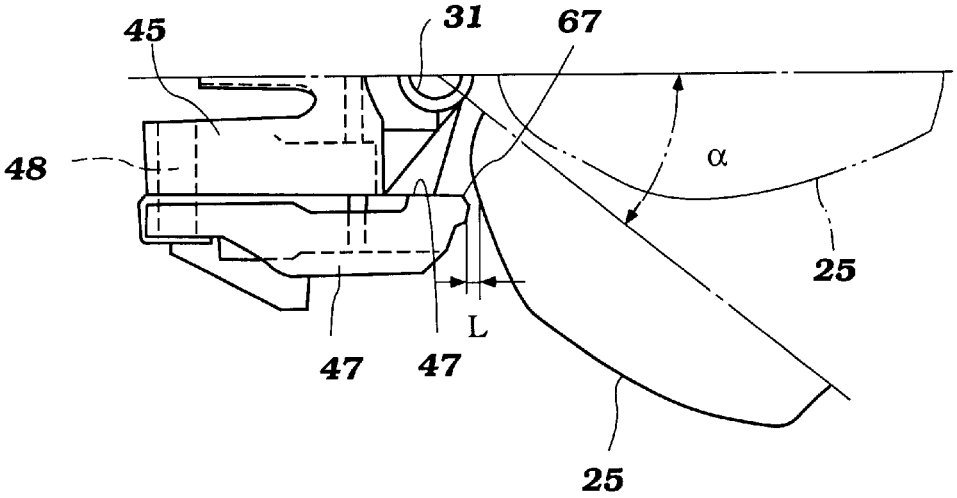
FIG. 10 is a top plan view of one-half of the outboard motor showing how the clamping bracket is arranged so as to permit a wide range of steering movement of the outboard motor while still maintaining good side thrust control.

In accordance with the invention, therefore, the clamping brackets 47 are each provided with a pair of lug portions or pads 65 which engage outwardly extending flanges 66 formed on the sides of the swivel bracket 45. As may be seen in FIG. 10, it is desirable that the clamping brackets 47 be relatively short in length rearwardly of the transom 49 of the watercraft so as to permit steering through a maximum steering angle $\alpha$. Thus, the trailing edges 67 of the clamping brackets 47 are left with a clearance L from the drive shaft housing 25 in these extreme positions.

Good side support is provided by the lugs or pads 65 and their engagement with their flanges 66 of the swivel bracket 45. In addition, and as best seen in FIG. 3, the sides of the swivel bracket 45 are provided with further lugs or pads 68 which extend outwardly a sufficient distance so as to engage planar facing surfaces of the clamping bracket 47 so that there is support at vertically spaced points along the vertical height of the swivel bracket 45 during the movement in the various trim adjusted positions which minimizes the loading on the trim pin 48.

Conventionally, the lead wires for supplying the electrical power to the electric motor 61 of the tilt and trim unit 62 have passed upwardly along the swivel bracket and then have passed through openings formed therein quite far from the tilt and trim pivot pin 48. As a result, there has been a large extent of exposed wires and slack must be left in the wiring system in order to accommodate the relative movement between the swivel bracket and the clamping bracket during tilt and trim operation.

Figure 4:
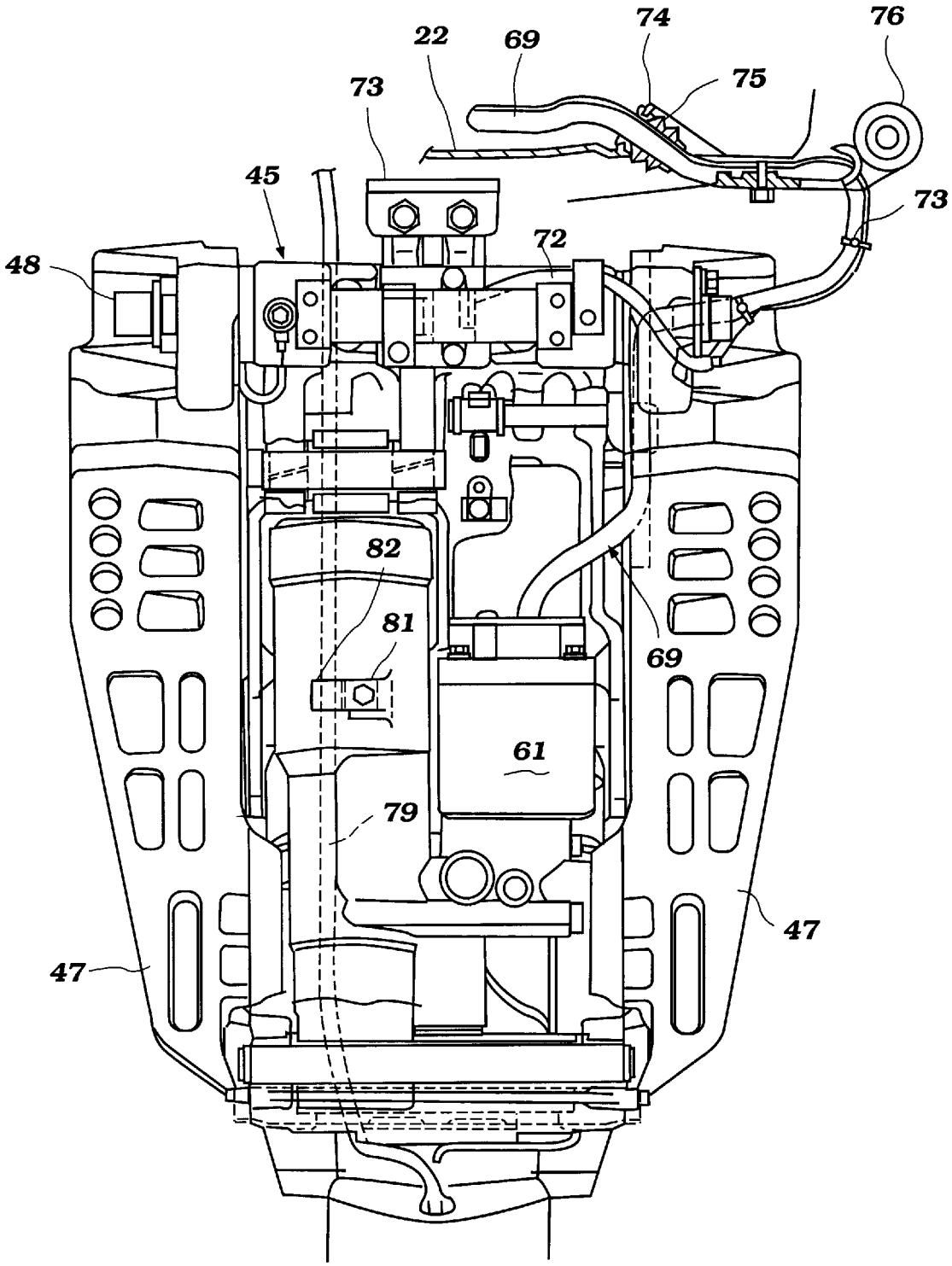
FIG. 4 is a front elevational view of the mounting portion of the outboard motor and specifically showing the clamping bracket, swivel bracket, and tilt and trim arrangement associated therewith.
Figure 11:
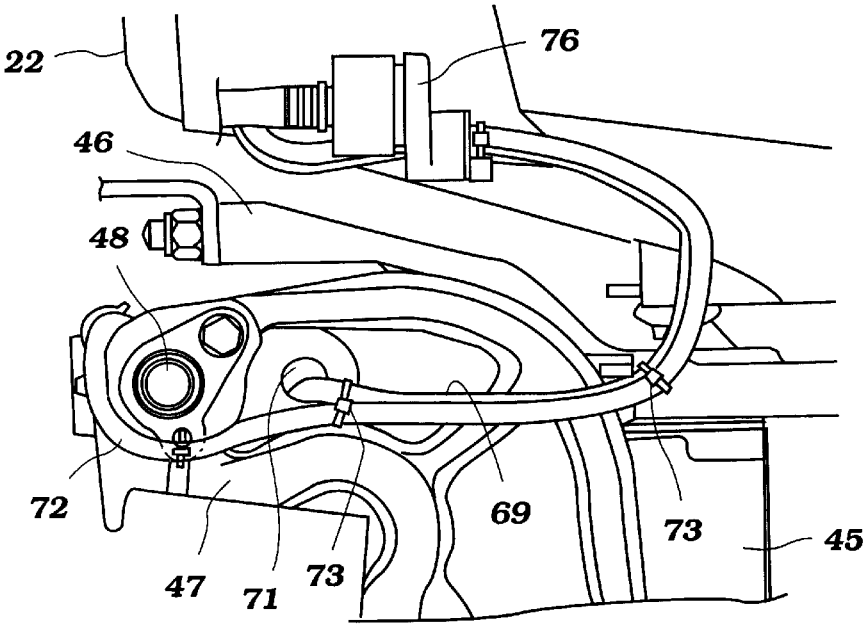
FIG. 11 is an enlarged view looking in the same general direction as FIG. 2 but shows in more detail how the electrical connections are interrelated with the trim axis and the associated power head.
Figure 12:
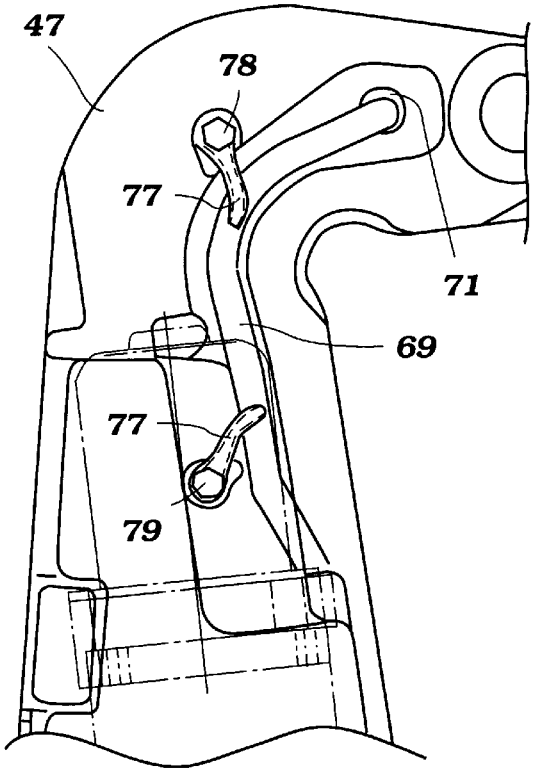
FIG. 12 is an enlarged view looking in the opposite direction from FIG. 11 and again show's the inner relationship of the electrical connections.

Therefore, in accordance with another feature of the invention, the electrical cabling for supplying the power to and from the hull is simplified as best seen in FIGS. 4, 11, and 12. As may be seen, a wire harness, indicated generally by the reference numeral 69 extends upwardly from the electric motor 61 along one side of the swivel bracket. This wire then passes through an aperture 71 formed in one of the clamping brackets 47 that is quite close to the tilt and trim pivot pin 48.

In addition, a further conductor 72 extends from a trim condition sensor 73 across the front of the clamping and swivel bracket assembly and is joined with the wire harness 69 by cable straps 73. These conduits then pass upwardly through with the wire harness 69 eventually passing through an opening 74 in the tray portion 22 that is surrounded by a grommet 75 for attachment remotely to the control assembly.

The trim sensor conduit 72 extends upwardly to a fitting 76 that provides an external connection to the wiring system for the trim adjuster. Finally, as seen in FIG. 12, the harness 69 is interrupted and a pair of ground connectors 77 extend through it and have connections to the clamping brackets 47 as at 78 and to the swivel bracket as at 79.

As may be best seen in FIGS. 1, 3, and 13, the watercraft 51 may be provided with a vessel speed indicator, indicated by the reference numeral 77 that is mounted in proximity to the operator's portion of the hull. This speed sensor 77 is provided with a vessel speed signal from a pitot pickup 78 formed in the front of the lower unit outer housing 26.

A conduit 79 extends upwardly from this pitot pickup 78 as seen in FIGS. 3 and 13 and passes generally parallel to the axis of the steering shaft 37 and quite close to it. The conduit 79 may be held in place relative to the swivel bracket by means of a clamp 81 and fastener 82. At its upper end, this conduit 79 passes through an opening in the tray 22 that is surrounded by a grommet 83. The conduit then can extend forwardly through the hull to a transducer assembly 84 that converts the pressure signal into a voltage signal for providing an indication of vessel speed.

Thus, it should be apparent from the Foregoing description that the described construction and mounting arrangement for the outboard motor provides a neat, compact assembly in which side thrusts are taken between the swivel bracket and clamping bracket and not avoiding transmission of these forces to the tilt pin. In addition, the conduit and electrical circuitry is such that the wiring and pitot tube conduit are neat, can be kept of minimum length and will be subject to minimum flexures.

Of course, the foregoing description is that of a preferred embodiment of the invention and various changes and modifications may be made without departing from the spirit and scope of the invention, as defined by the appended claims.

What is claimed is:

1. An outboard motor having a propulsion unit comprised of a power head containing a powering prime mover and a lower unit containing a propulsion device driven by said prime mover through a transmission, the propulsion unit is mounted on a steering shaft within a swivel bracket for steering movement of said outboard motor about a generally vertically extending steering axis said swivel bracket being connected by a pivot pin to a clamping bracket that is affixed to the hull of an associated watercraft for tilt and trim movement of said swivel bracket and said propulsion unit relative to said clamping bracket and the watercraft hull, said clamping bracket being comprised primarily of a pair of spaced apart side plates that extend along opposite sides of said swivel bracket, and interengaging thrust-taking pads formed on said swivel bracket and said side plates of said clamping bracket so as to take side thrusts during at least the trim range of movement of said outboard motor.

2. An outboard motor as set forth in claim 1 wherein the pads are formed on the side plates and engage planar surfaces on the swivel bracket.

3. An outboard motor as set forth in claim 1 wherein the pads are formed on the swivel bracket and engage planar surfaces on the side plates.

4. An outboard motor as set forth in claim 3 wherein pads are also formed on the side plates and engage planar surfaces on the swivel bracket.

5. An outboard motor as set forth in claim 4 wherein the side plate pads are vertically spaced from the swivel bracket pads.

6. An outboard motor as set forth in claim 4 wherein the side plate pads are longitudinally spaced from the swivel bracket pads.

7. An outboard motor as set forth in claim 6 wherein the side plate pads are also vertically spaced from the swivel bracket pads.

8. An outboard motor as set forth in claim 1 wherein the side plates are formed with a series of trim pin openings for receiving a trim pin engageable by the swivel bracket for setting a positive, trim down stop.

9. An outboard motor as set forth in claim 8 wherein the trim pin apertures are vertically spaced from the pads.

10. An outboard motor as set forth in claim 8 wherein the trim pin apertures are horizontally spaced from the pads.

11. An outboard motor as set forth in claim 10 wherein the trim pin apertures are also vertically spaced from the pads.

12. An outboard motor as set forth in claim 1 further including a conductor for conducting at least one of fluid or electrical energy extending from a forward portion of the lower unit upwardly in an area contiguous to the axis defined by the steering shaft and passing through the protective cowling of the outboard motor for transmitting signals.

13. An outboard motor having a propulsion unit comprised of a power head having a protective cowling containing a powering prime mover and a lower unit contains a propulsion device driven by said prime mover through a transmission, the propulsion unit is mounted on a steering shaft within a swivel bracket for steering movement of said outboard motor about a generally vertically extending steering axis said swivel bracket being connected by a pivot pin to a clamping bracket that is affixed to the hull of an associated watercraft for tilt and trim movement of said swivel bracket and said propulsion unit relative to said clamping bracket and the watercraft hull, said clamping bracket being comprised primarily of a pair of spaced apart side plates that extend along opposite sides of said swivel bracket, thrust-taking pads formed on said swivel bracket and said side plates of said clamping bracket so as to take side thrusts during at least the trim range of movement of said outboard motor and a hydraulic tilt and trim unit acting between the swivel bracket and the clamping bracket for effecting the tilt and trim movement, said hydraulic tilt and trim unit being electrically powered, and electrical conductors extend from said hydraulic tilt and trim unit generally upwardly to a position close to said pivot pin and from there through said protective cowling for transmitting electrical power to said tilt and trim unit.

14. An outboard motor as set forth in claim 13 further including a conductor for conducting at least one of fluid or electrical energy extending from a forward portion of the lower unit upwardly in an area contiguous to the axis defined by the steering shaft and passing through the protective cowling of the outboard motor for transmitting signals.

15. An outboard motor having a propulsion unit comprised of a power head having a protective cowling containing a powering prime mover and a lower unit containing a propulsion device driven by said prime mover through a transmission, the propulsion unit is mounted on a steering shaft within a swivel bracket for steering movement of said outboard motor about a generally vertically extending steering axis, said swivel bracket being connected by a pivot pin to a clamping bracket that is affixed to the hull of an associated watercraft for tilt and trim movement of said swivel bracket and said propulsion unit about a pivot pin axis relative to said clamping bracket and the watercraft hull, a hydraulic tilt and trim unit acting between the swivel bracket and the clamping bracket for effecting the tilt and trim movement, said hydraulic tilt and trim unit being electrically powered, and electrical conductors for conducting electrical energy to said hydraulic tilt and trim unit extending from a forward portion of said lower unit upwardly to a position close to said pivot pin axis in an area contiguous to said steering axis and passing through said protective cowling of the outboard motor for transmitting signals.

16. An outboard motor having a propulsion unit comprised of a power head having a protective cowling containing a powering prime mover and a lower unit containing a propulsion device driven by said prime mover through a transmission, said propulsion unit being mounted on a steering shaft within a swivel bracket for steering movement of said outboard motor about a generally vertically extending steering axis, said swivel bracket being connected by a pivot pin to a clamping bracket that is affixed to the hull of an associated watercraft for tilt and trim movement of said swivel bracket and said propulsion unit relative to said clamping bracket about a pivot pin axis and the watercraft hull, a hydraulic tilt and trim unit acting between said swivel bracket and said clamping bracket for effecting the tilt and trim movement, said hydraulic tilt and trim unit being electrically powered, and electrical conductors extend from said hydraulic tilt and trim unit generally upwardly to a position close to said pivot pin axis and from there through said protective cowling for transmitting electrical power to said tilt and trim unit.

* * * * *